US005902155A

United States Patent [19]

Polgar et al.

[11] Patent Number: 5,902,155

[45] Date of Patent: May 11, 1999

[54] ELECTRICAL CONNECTOR ASSEMBLY

[75] Inventors: Gary E. Polgar, Bolingbrook; Rupert J. Fry, Mount Prospect; Randy Joe Kempf, Naperville; Joseph D. Comerci, Elmhurst, all of Ill.; John S. Luthy, Claremore, Okla.

[73] Assignee: Molex Incorporated, Lisle, Ill.

[21] Appl. No.: 08/919,847

[22] Filed: Aug. 28, 1997

[51] Int. Cl.[6] ..... H01R 13/64

[52] U.S. Cl. ..... 439/680; 439/353; 439/701

[58] Field of Search ..... 439/350–358, 439/680, 681, 701

[56] References Cited

U.S. PATENT DOCUMENTS

| | | | |
|---|---|---|---|
| 3,576,520 | 4/1971 | Stouffer . | |
| 4,090,764 | 5/1978 | Malsby et al. . | |
| 4,596,436 | 6/1986 | Kraemer et al. . | |
| 4,787,860 | 11/1988 | Bender | 439/358 |
| 4,875,880 | 10/1989 | Welch et al. | 439/536 |
| 4,909,757 | 3/1990 | Reed | 439/532 |
| 4,915,641 | 4/1990 | Miskin et al. | 439/247 |
| 5,254,018 | 10/1993 | Sawada | 439/901 X |
| 5,290,175 | 3/1994 | Robinson et al. | 439/540 |
| 5,425,650 | 6/1995 | Maeda | 439/680 X |

FOREIGN PATENT DOCUMENTS

| | | | |
|---|---|---|---|
| 4311781 | 6/1994 | Germany | H01R 13/514 |

*Primary Examiner*—Khiem Nguyen
*Attorney, Agent, or Firm*—Stephen Z. Weiss

[57] ABSTRACT

An electrical connector assembly includes a shroud having side walls forming a receptacle defining a mating axis. A polarizing groove is disposed in one of the side walls extending generally parallel to the mating axis. A latch is disposed in the polarizing groove. A modular connector is insertable into the receptacle along the mating axis and includes a latch projection adapted for moving into the polarizing groove and latchingly engaging the latch of the shroud in the polarizing groove. Therefore, the latch projection on the modular connector cooperates with the polarizing groove and latch on the shroud to perform the dual function of providing a polarizing means and a latch means.

15 Claims, 7 Drawing Sheets

ELECTRICAL CONNECTOR ASSEMBLY

FIELD OF THE INVENTION

This invention generally relates to the art of electrical connectors and, particularly, to an electrical connector assembly which includes a shroud mounting a plurality of modular connectors with polarization and latching means between the shroud and the modules.

BACKGROUND OF THE INVENTION

Generally, an electrical connector includes a dielectric housing mounting a plurality of conductive terminals. The housing may be molded of plastic material or the like, and the terminals may be formed of conductive metal material. The connector is adapted for mechanical connection to a complementary connecting device, such as a second mating connector, for electrically interconnecting the terminals of the two connectors.

In some instances, it is desirable to provide a system wherein a plurality of modular connectors of the character described above are mounted in a singular structure, such as an outer shroud, for conjointly mating the plurality of modular connectors with a plurality of complementary connectors of a mating assembly.

Typically, some form of latch means is provided to securely hold the modular connectors within the outer shroud. In addition, it is desirable to provide some form of polarizing means to ensure that the modular connectors are inserted into the shroud in a particular orientation. These various means, along with other latches and mechanisms on the connector, often cause the assemblies to become rather complex and expensive. The various extraneous means on an otherwise simple and inexpensive connector structure also increase the size envelope of the connector module in an industry where miniaturization and high density has become very demanding.

In addition it is desirable to allow the use of a variety of modular connectors at a variety of locations in the shroud after manufacture of the modular connectors and shrouds. The versatility of mixing modular connectors and their locations could result in lower manufacturing costs due to fewer parts being needed. Also a single modular connector was desired which could be easily removed in the field for replacement, repair, or modification while the remaining modular connectors could be reused.

The present invention is directed to solving these problems by providing a unique system where singular components perform dual functions of both latching and polarizing to, thereby, reduce the overall complexity and size envelope of the connector assembly.

SUMMARY OF THE INVENTION

An object, therefore, of the invention is to provide a new and improved electrical connector assembly having a shroud and a modular connector with complementary interengaging latching and polarizing means.

In the exemplary embodiment of the invention, the shroud has side walls forming a receptacle defining a mating axis. A polarizing groove is formed in one of the side walls extending generally parallel to the mating axis. A latch is provided directly in the polarizing groove. The modular connector is insertable into the receptacle along the mating axis and includes a latch projection adapted for moving into the polarizing groove and latchingly engaging the latch of the shroud in the groove. Therefore, the latch projection on the modular connector cooperates with the polarizing groove and latch on the shroud to perform the dual function of providing a polarizing means as well as a latch means.

As disclosed herein, the latch on the shroud is provided by a flexible latch arm having a latch hook thereon. The flexible latch arm is cantilevered in the direction of insertion of the modular connector into the receptacle of the shroud. The latch projection is shown herein as a flange extending transversely of the mating axis.

In the preferred embodiment, the shroud has side walls forming a plurality of the receptacles for receiving a plurality of the modular connectors. Each receptacle includes one of the polarizing grooves with one of the latches therein. Each modular connector includes one of the latch projections. The receptacles in the shroud are substantially identical, and the modular connectors have substantially identical outer configurations, whereby any one of the modular connectors can be inserted into any one of the receptacles.

Another feature of the invention is the provision of a second polarizing groove in a second one of the side walls of the receptacle, with a polarizing rib on the modular connector remote from the latch projection for moving into the second polarizing groove. As disclosed herein, the two polarizing grooves are in opposite side walls of the receptacle, and the polarizing rib and the latch projection are on opposite sides of the modular connector. In the preferred embodiment, a pair of the second polarizing grooves are provided in the second one of the side walls of the receptacle, and a pair of the polarizing ribs are provided on the modular connector for moving into the pair of second polarizing grooves.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
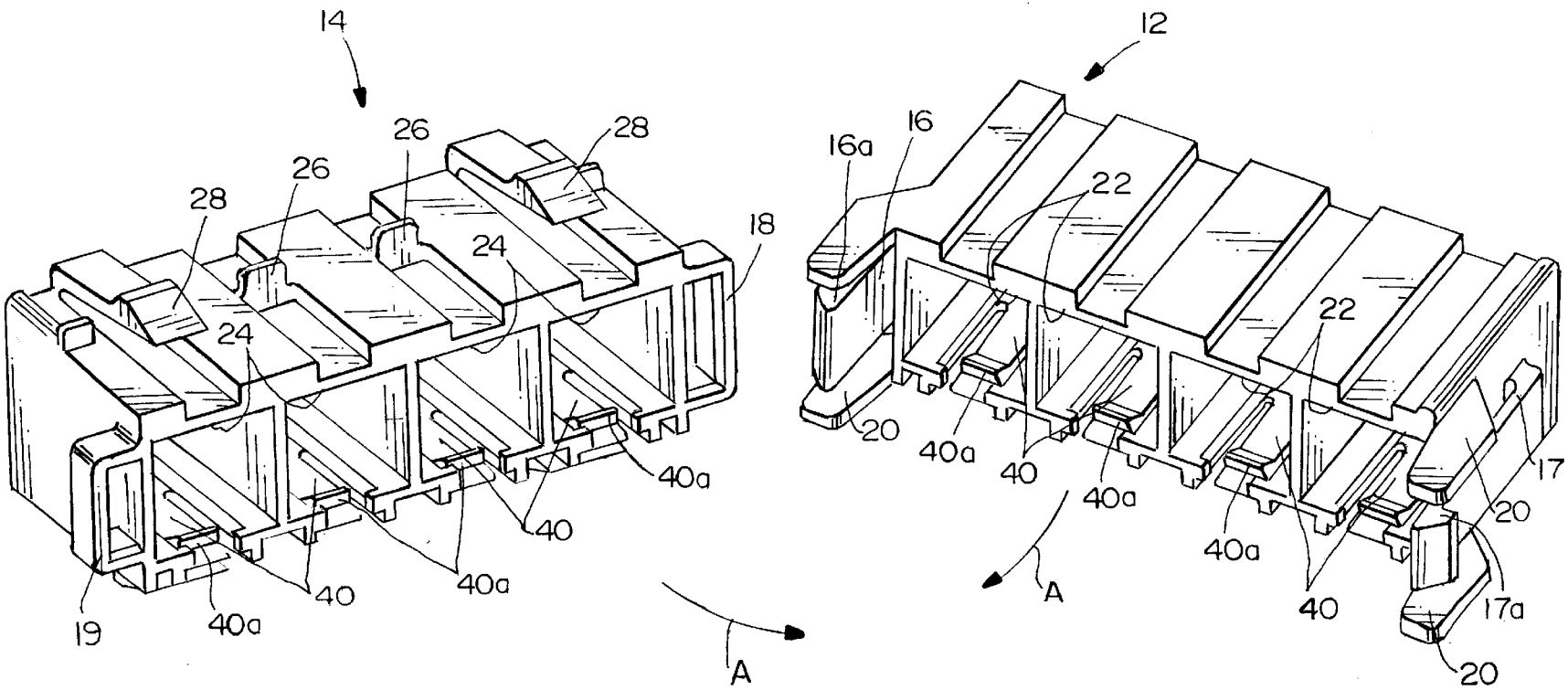
FIG. 1 is a perspective view of a pair of mateable shrouds without modular connectors of a pair of electrical connector assemblies according to the invention.

Referring to the drawings in greater detail, the invention is embodied in a pair of electrical connector assemblies, with each assembly including an outer shroud mounting a plurality of modular connectors. FIG. 1 shows a first or right-hand shroud, generally designated 12, and a second or left-hand shroud, generally designated 14. No connector modules are shown. The two shrouds are mateable or interconnectable in the direction of arrows "A". Each shroud is an elongated one-piece structure unitarily molded of dielectric material such as plastic or the like.

More particularly, first shroud 12 has a latch arms 16 and 17, latch arm 16 being wider than latch arm 17, cantilevered from each opposite end thereof and projecting in a forward mating direction. The latch arms have latch hooks 16*a* and 17*a* respectively, latch hook 16*a*being wider than latch hook 17*a* for latching engagement behind bridges 18 and 19 of second shroud 14, bridge 18 being wider than bridge 19. The wider latch hook 16*a* on the wider latch arm 16 is adapted to lock behind the wider bridge 18. Similarly, the narrower latch hook 17*a* on the narrower latch arm 17 is adapted to lock behind the narrower bridge 19. This wide/narrow relationship ensures the proper orientation between shrouds 12 and 14. First shroud 12 has a pair of side arms 20 to protect latch arms 16 and 17 from becoming caught on extraneous objects. Bridges 18 and 19 of second shroud 14 not only provide latch means for latch hooks 16*a* and 17*a*, but the bridges perform a dual function of providing an anti-overstress means for latch arms 16 and 17 when the shrouds are mated, to prevent the latch arms from being pulled outwardly away from the mated assembly.

First shroud 12 defines a plurality of through receptacles 22 for receiving a plurality of modular connectors shown in FIGS. 7 and 8 and described hereinafter. Second shroud 14 has a plurality of through receptacles 24 for receiving a plurality of modular connectors shown in FIGS. 9 and 10 and described hereinafter. Lastly, second shroud 14 has a pair of abutment tabs 26 and flexible latch tabs 28 for sandwiching a panel therebetween. In other words, the second shroud 14 (along with its modular connectors) can be fixed within an aperture in an appropriate panel or other support structure, and first shroud 12 (along with its modular connectors) can be mated with the fixed shroud 14.

Figure 2:
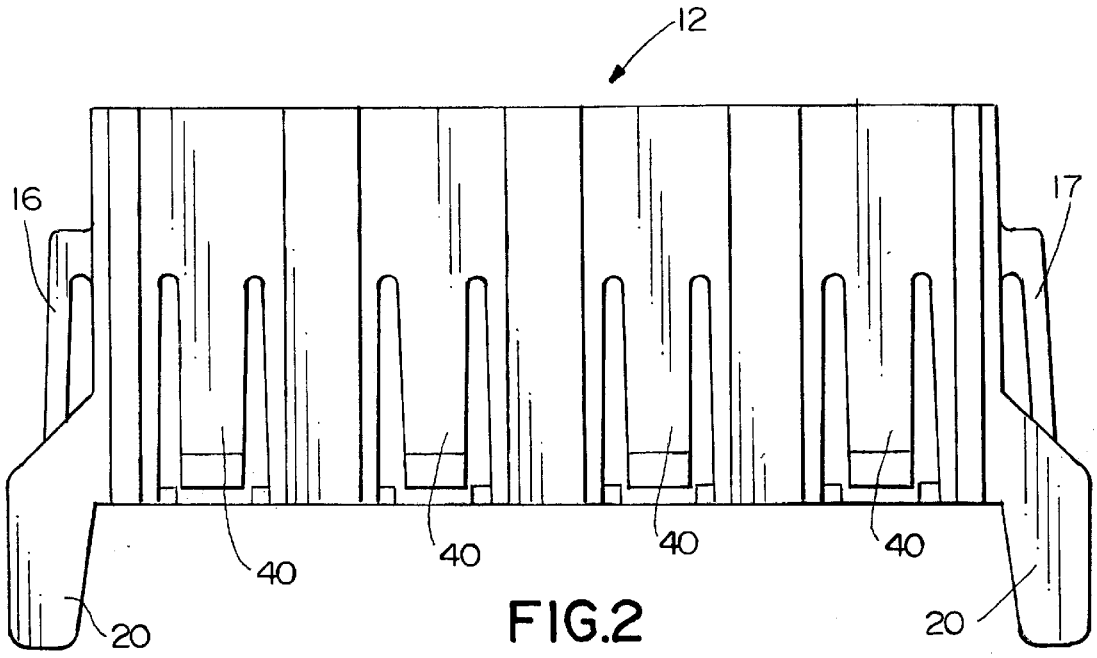
FIG. 2 is a top plan view of the first (right-hand) shroud in FIG. 1.
Figure 3:
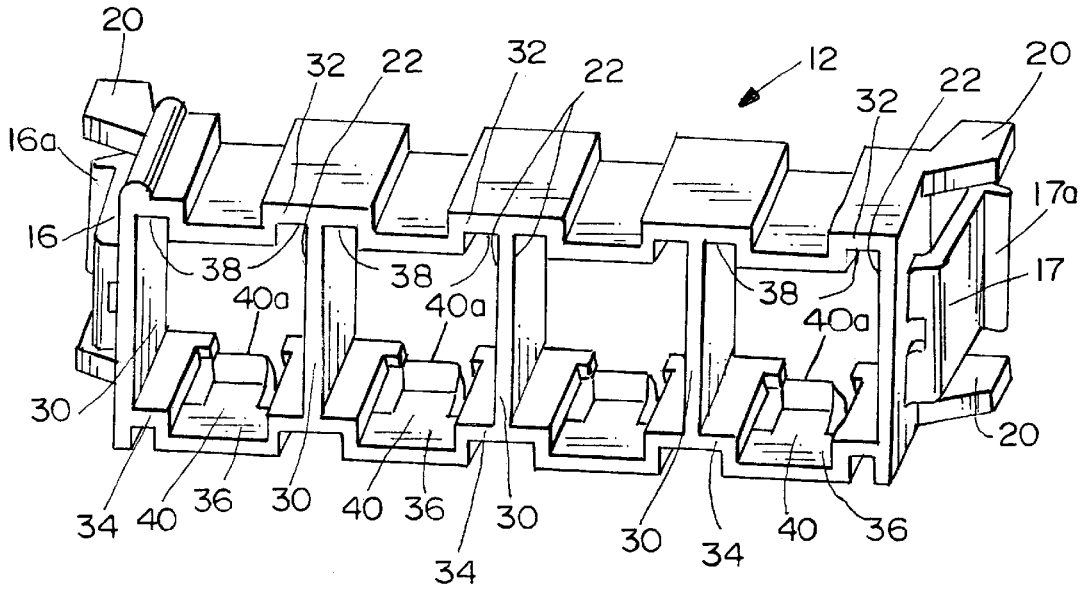
FIG. 3 is a rear perspective view of the first shroud.

Referring to FIGS. 2 and 3 in conjunction with FIG. 1, first shroud 12 has side walls 30, 32 and 34 which define receptacles 22. Actually, side walls 32 and 34 could be considered top and bottom walls, respectively, but it must be understood that the entire electrical connector assembly shown herein is omni-directional in use. The side walls form the receptacles generally on axes parallel to the mating axis of the two shrouds. Bottom wall 34 of each receptacle 22 is provided with a first polarizing groove 36 extending generally parallel to the mating axis, and top wall 32 of each receptacle is provided with a pair of laterally spaced second polarizing grooves 38 as best seen in FIG. 3. Polarizing grooves 38 stop short of the front of the shroud, which can be understood from FIG. 1 wherein the polarizing grooves cannot be seen. A flexible latch arm 40, having a latch hook 40*a*, is disposed in polarizing groove 36. The flexible latch arm is cantilevered in a forward direction and, actually, the latch arm forms a continuation of the bottom wall of polarizing groove 36.

Figure 4:
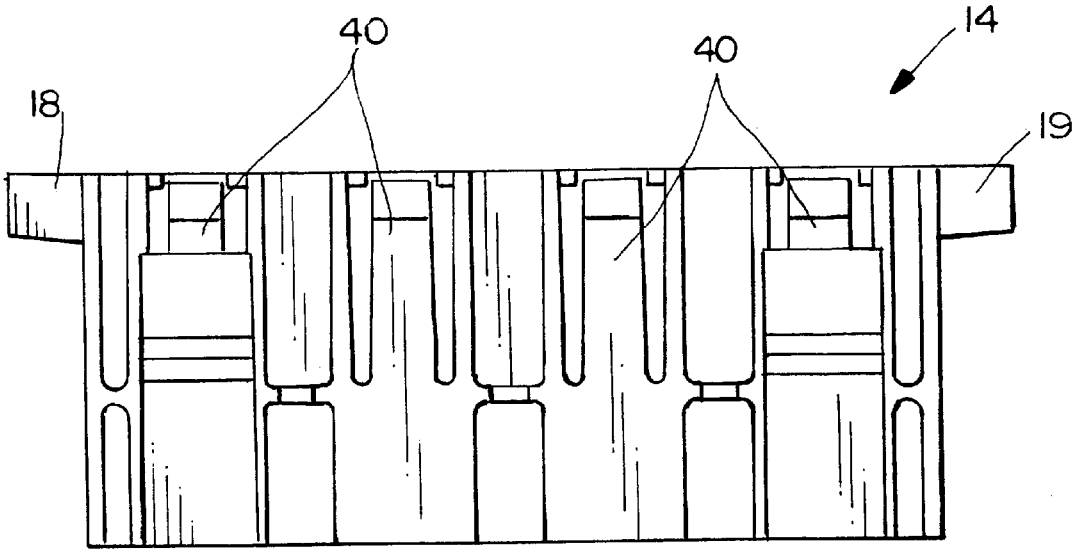
FIG. 4 is a top plan view of the second (left-hand) shroud in FIG. 1.
Figure 5:
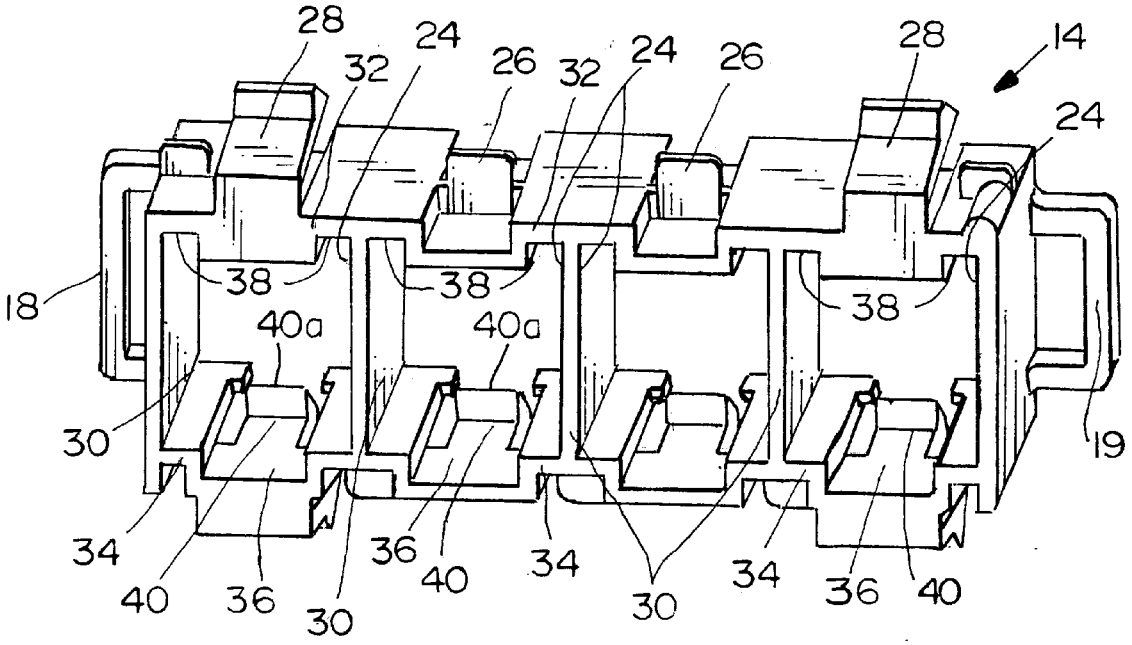
FIG. 5 is a rear perspective view of the second shroud.

Referring to FIGS. 4 and 5 in conjunction with FIG. 1, second shroud 14 has a similar polarizing and latching structure as described above in relation to first shroud 12. Therefore, like reference numerals have been added to designate like components.

More particularly, second shroud 14 includes a plurality of side walls 30, 32 and 34 which define each receptacle 24. A first polarizing groove 36 again is formed in bottom wall 34 for each receptacle, and a pair of laterally spaced second polarizing grooves 38 are formed in top wall 32. Again like first shroud 12, second shroud 14 includes a flexible latch arm 40 within each polarizing groove 36 of each receptacle 24. The flexible latch arm is cantilevered in a forward direction and includes a forward latch hook 40*a*.

Figure 6:
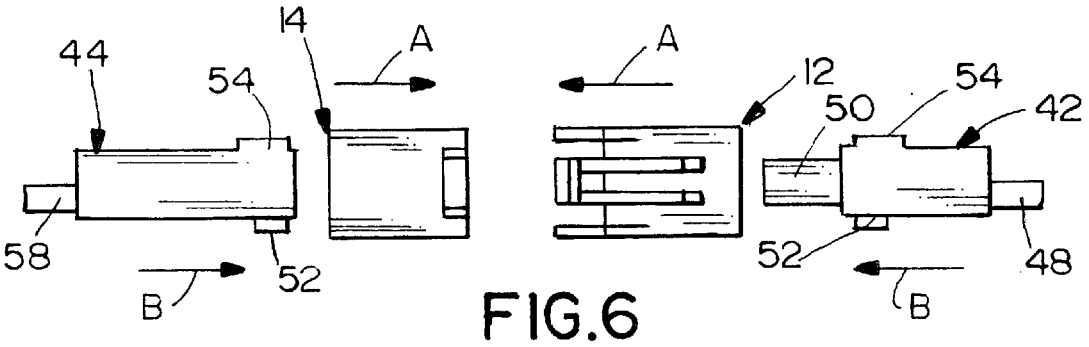
FIG. 6 is a side elevational view of the shrouds and their respective modular connectors in a preassembled position.

Referring to FIG. 6, first and second shrouds 12 and 14, respectively, are shown mateable in the direction of arrows "A". FIG. 6 also shows first and second modular connectors, generally designated 42 and 44, which are insertable into the rear of shrouds 12 and 14, respectively, in the direction of arrows "B".

Figure 7:
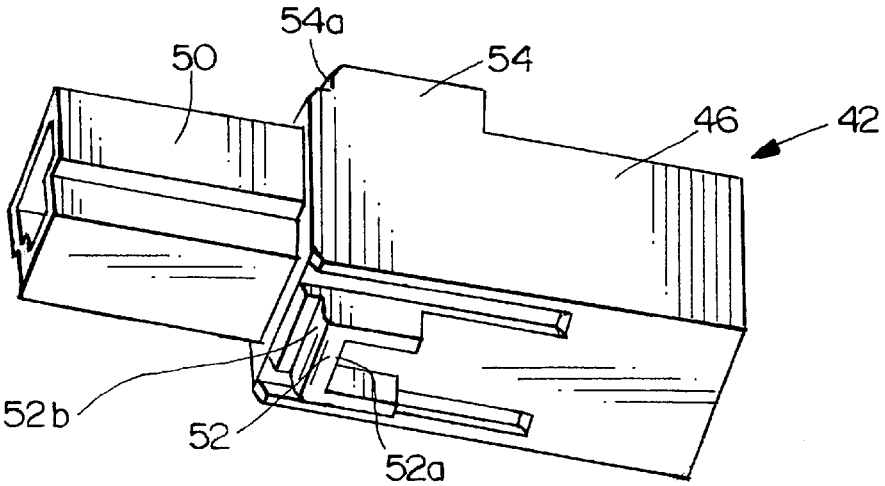
FIG. 7 is a bottom perspective view of one of the modular connectors for insertion into the first or right-hand shroud in FIG. 1 and 6.
Figure 8:
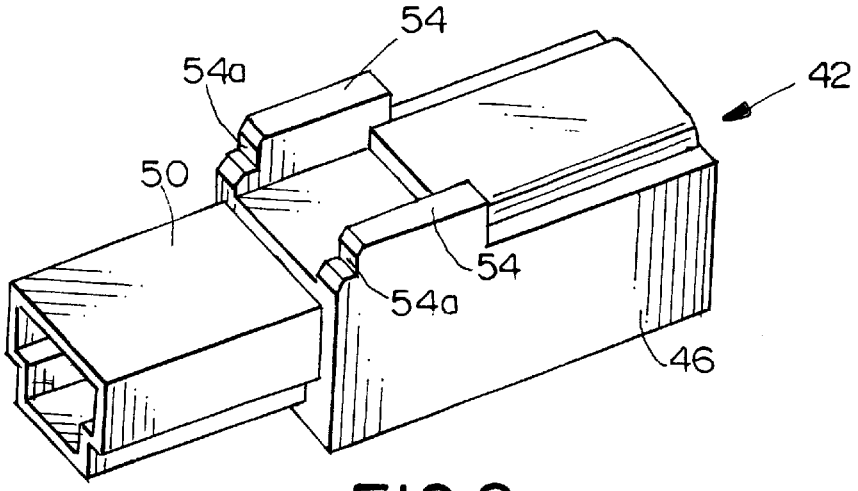
FIG. 8 is a top perspective view of the modular connector of FIG. 7.

FIGS. 7 and 8 show modular connector 42 which is insertable into the rear of first shroud 12. The connector includes a molded plastic housing 46 which mounts one or more conductive terminals which, in turn, are terminated to the conductors of an electrical cable 48 projecting from the rear of the connector as seen in FIG. 6. Connector 42 has a forward mating end 50. FIG. 7 shows that connector 42 has a latch projection in the form of a transverse flange 52 projecting from housing 46. This flange forms a rearwardly facing latch shoulder 52*a*. FIG. 8 shows that connector 42 has a pair of axially extending polarizing ribs 54 projecting upwardly of housing 46. The ribs terminate in forward abutment shoulders 54*a*.

When modular connector 42 is inserted into the rear of first shroud 12 as indicated by the right-hand arrow "B" in FIG. 6, latch flange 52 slides within polarizing groove 36 (FIG. 3) of one of the receptacles 22 of shroud 12. At the same time, polarizing ribs 54 slide into upper polarizing grooves 38 until abutment shoulders 54*a* of the ribs bottom out at the front 38*a* of the receptacle. When fully inserted, the latch shoulder 52*a* of flange 52 snaps behind latch hook 40*a* at the forward end of the flexible latch arm 40 within the respective receptacle and forward wall 52*b* of flange 52 bottoms out at the stop 36*a* at the end of polarizing groove 36.

Figure 9:
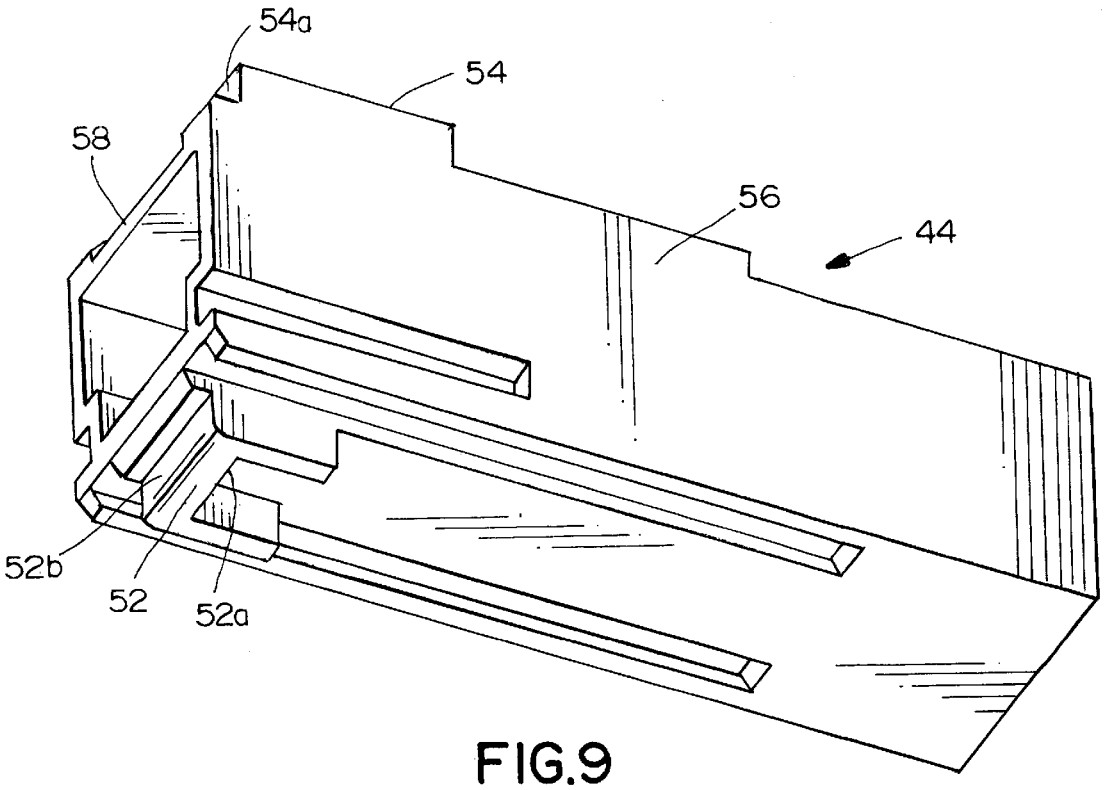
FIG. 9 is a bottom perspective view of one of the modular connectors for insertion into the second or left-hand shroud in FIG. 1 and 6.
Figure 10:
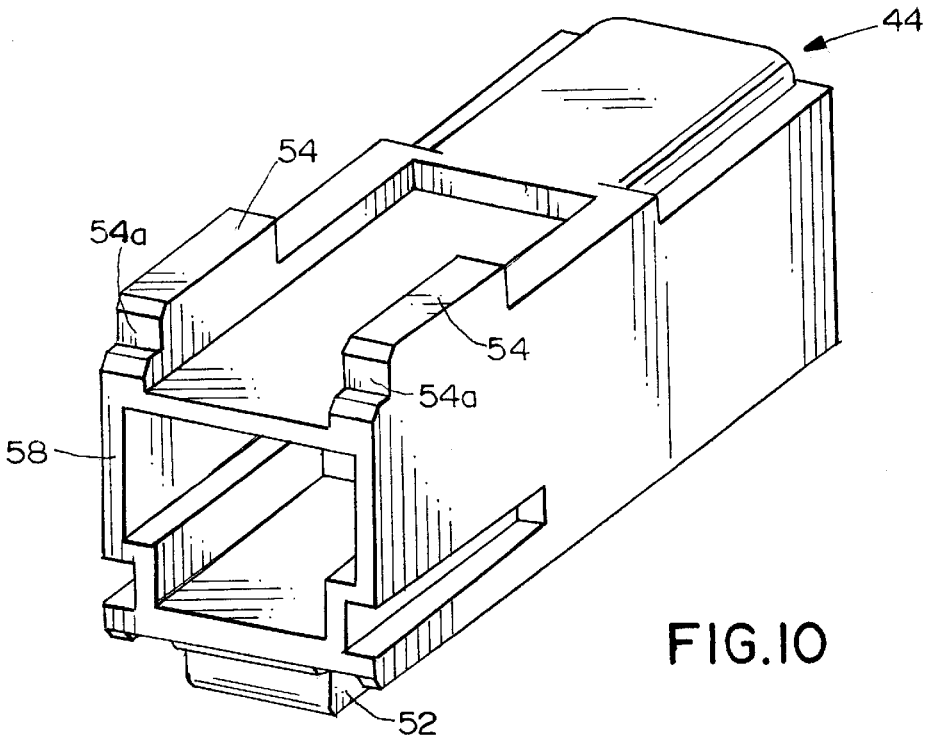
FIG. 10 is a top perspective view of the modular connector of FIG. 9.

FIGS. 9 and 10 show modular connector 44 which is insertable into the rear of second shroud 14 as indicated by the left-hand arrow "B" in FIG. 6. Like modular connector 42, connector 44 has a molded dielectric housing 56 which mounts a plurality of conductive terminals which, in turn, are terminated to the conductors of an electrical cable 58 projecting from the rear of the connector as seen in FIG. 6. Like modular connector 42, modular connector 44 has a transverse flange 52 at the bottom thereof, defining a rearwardly projecting latch shoulder 52*a*. Similar polarizing ribs 54 also project upwardly of connector 44, defining forward abutment shoulders 54*a*.

When modular connector 44 is inserted into second shroud 14, flange 52 slides in polarizing groove 36 and ribs 54 slide in polarizing grooves 38 until the abutment shoulders 54*a* of ribs 54 bottom out in grooves 38. At this point, flange 52 snaps behind latch hook 40*a* of the flexible latch arm 40 within the respective receptacle 24 of second shroud 14.

Modular connector 44 has an open mating end as indicated at 58 in FIGS. 9 and 10. When shrouds 12 and 14 are interconnected as shown by arrows "A" in FIG. 6, front mating end 50 (FIGS. 7 and 8) of modular connector 42 mates within open mating end 58 (FIGS. 9 and 10) of modular connector 44.

FIGS. 11A–11D show the sequence of movement of modular connector 42 into the rear of one of the receptacles 22 of first shroud 12. However, it should be understood that this action is the same for the insertion of modular connector 44 into the rear of second shroud 14.

Figure 11A:
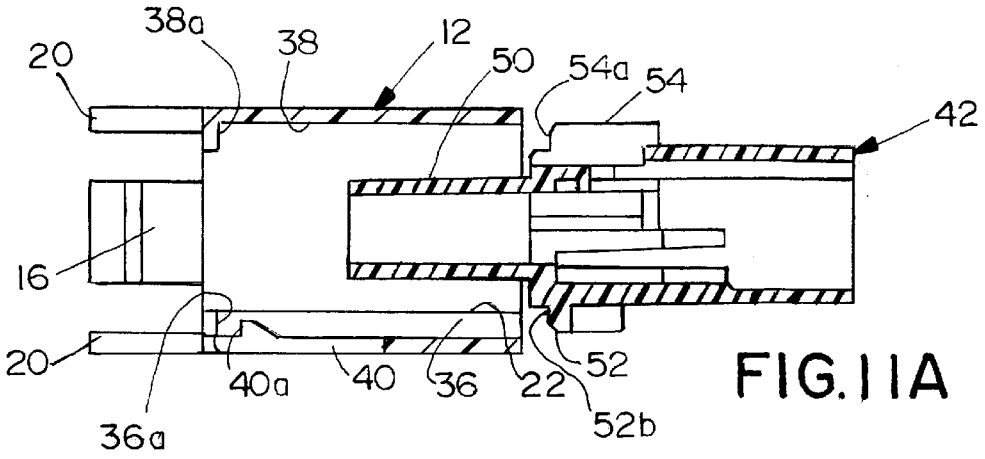
FIGS. 11A–11D are sequential axial sectional views showing the modular connector of FIGS. 7 and 8 being inserted into the first or right-hand shroud in FIG. 6.
Figure 11B:
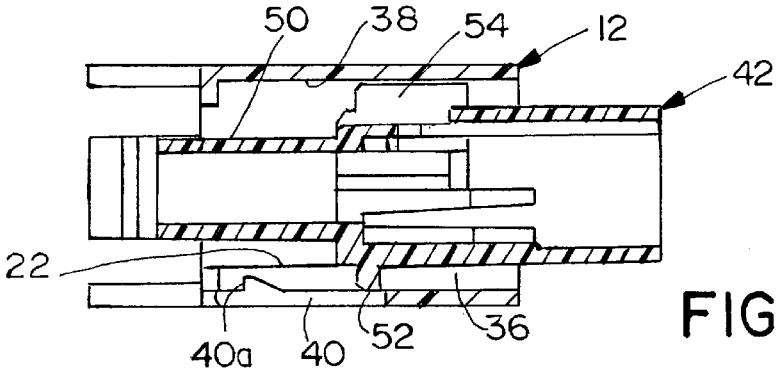

More particularly, FIG. 11A shows modular connector 42 slightly inserted into one of the receptacles 22 of first shroud 12, only to the extent that forward mating end 50 of the connector has entered the rear of the receptacle. FIG. 11B shows modular connector 42 inserted further into receptacle 22, to an extent that latch flange 52 at the bottom of the receptacle has entered polarizing groove 36, and polarizing ribs 54 at the top of the connector have entered polarizing grooves 38.

Figure 11C:
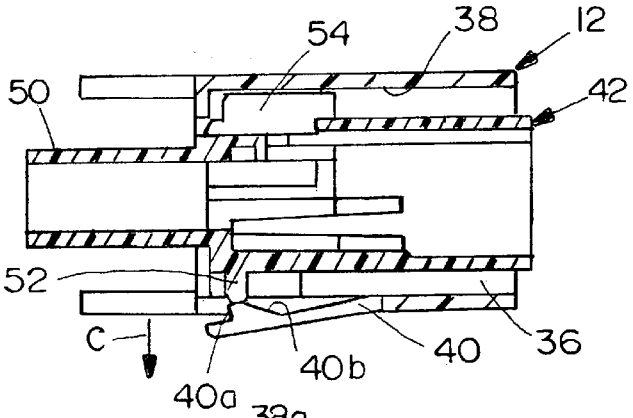

FIG. 11C shows modular connector 42 having been inserted further into receptacle 22 of shroud 12, to an extent that flange 52 has engaged the rear of latch hook 40*a* to bias flexible latch arm 40 downwardly in the direction of arrow "C". To that end, it can be seen that the rear surface 40*b* of latch hook 40*a* is inclined to facilitate this biasing action. During this additional insertion movement, upper polarizing ribs 54 continue to move or slide within polarizing grooves 38.

Figure 11D:
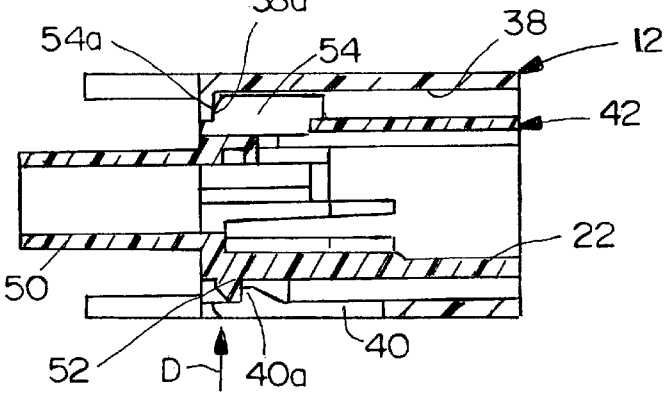

FIG. 11D shows modular connector 42 fully inserted into receptacle 22 of shroud 12, to an extent that the forward abutment shoulders 54*a* of upper polarizing ribs 54 have bottomed out at the front of grooves 38 to define the fully inserted position of the connector. Latch hook 40*a* of flexible latch arm 40 has snapped back upwardly in the direction of arrow "D", whereby the latch hook has latched behind flange 52 of the connector to hold the connector securely within its respective receptacle 22.

Upper polarizing ribs 54 perform a dual function of positively defining the fully inserted position of the modular connector, as well as providing further polarization, along with stability and guidance, of the connector into the shroud. All of the actions described above involved in inserted modular connector 42 into first shroud 12 as illustrated in FIGS. 11A–11D are equally applicable for the insertion of modular connector 44 into shroud 14. Consequently, the actions between connector 44 and shroud 14 will not be repeated herein.

Figure 12:
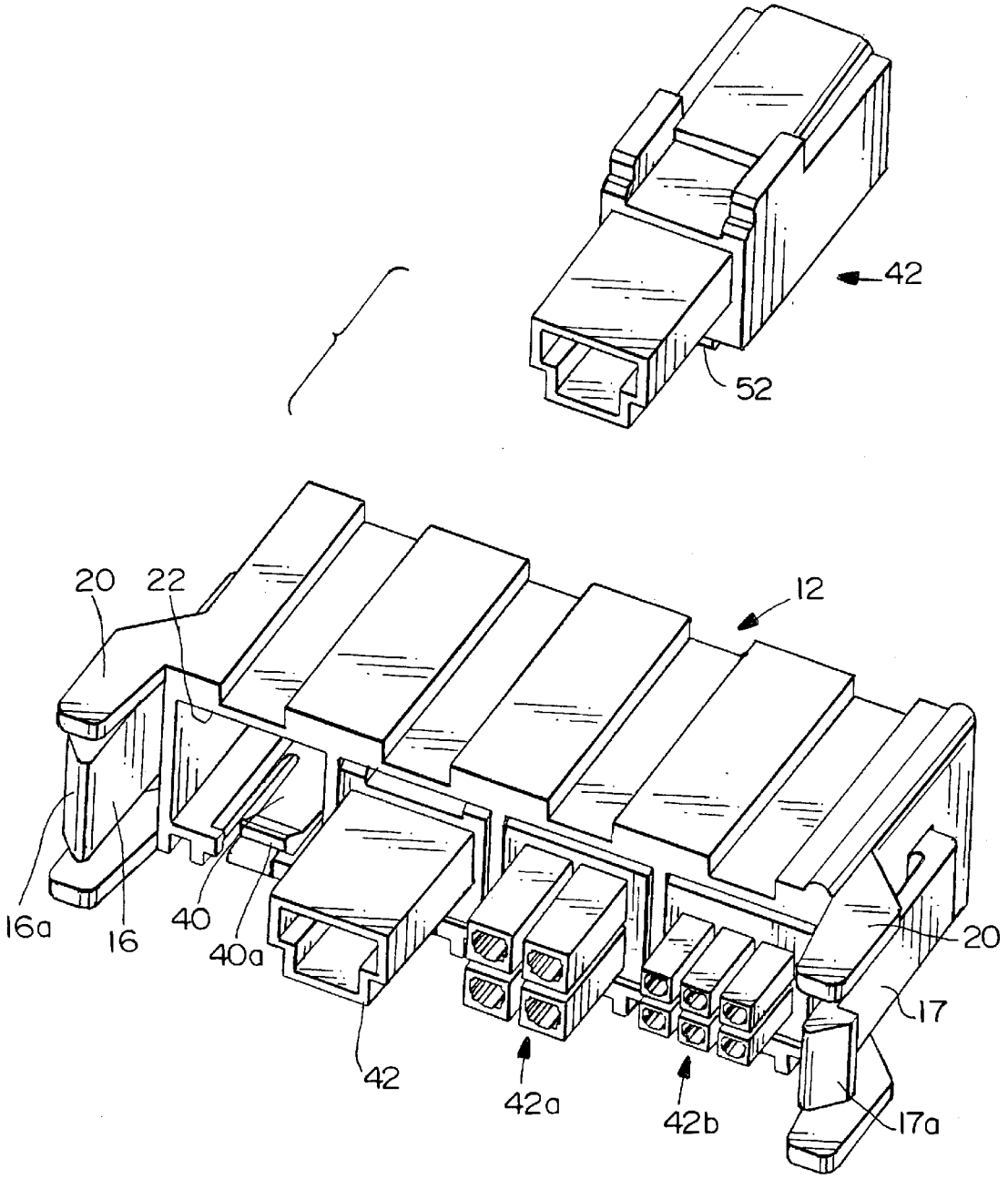
FIG. 12 is a perspective view of the first right hand shroud of FIG. 1 with a variety of connector modules.

Finally, it should be noted that each of the receptacles 22 in shroud 12 are substantially identical. In addition, it should be understood that each of the plurality of modular connectors which are insertable into receptacles 22 of the shroud will have substantially identical configurations, even though only one modular connector 42 has been described herein. As shown in FIG. 12, a plurality of modular connectors 42, 42*a* and 42*b* and their mating counterparts may have a wide variety of terminal arrangements, but the profile and exterior construction of the plurality of modular connectors are substantially identical so that any one of the plurality of modular connectors can be inserted into any one of the receptacles 22 of shroud 12 or receptacles 24 of shroud 14. Of course, this same scheme is true of modular connectors 44 insertable into the plurality of receptacles 24 of second shroud 14 or receptacles 22 of shroud 12. The terminal configuration or arrangement of the modular connectors can vary widely, but the external configuration, including the polarizing means, latch means, etc. is identical, again to allow for any one of a plurality of modular connectors to be inserted into any one of the receptacles 24 or receptacles 22.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly, comprising:

a shroud having side walls forming a receptacle defining a mating axis, a polarizing groove in one of the side walls extending from an insertion end of the shroud generally parallel to said mating axis, and a latch integrally formed with the shroud in the polarizing groove; and a modular connector insertable into said receptacle into said insertion end along said mating axis and including a fixed latch projection adapted for moving into said polarizing groove and latchingly engaging the latch of the shroud in the polarizing groove, whereby the latch projection on the modular connector cooperates with the polarizing groove and the latch on the shroud to perform the dual function of providing a polarizing means and a latch means.

2. The electrical connector assembly of claim 1 wherein said latch on the shroud comprises a flexible latch arm having a latch hook thereon.

3. The electrical connector assembly of claim 2 wherein said flexible latch arm is cantilevered in the direction of insertion of the modular connector into the receptacle of the shroud.

4. The electrical connector assembly of claim 1 wherein said latch projection comprises a flange extending transversely of said mating axis.

5. The electrical connector assembly of claim 1 wherein said shroud has side walls forming a plurality of said receptacles for receiving a plurality of said modular connectors, each receptacle including one of said polarizing grooves with one of said latches therein, and each modular connector including one of said latch projections.

6. The electrical connector assembly of claim 5 wherein said receptacles are substantially identical, and said modular connectors have substantially identical outer configurations, whereby any one of the modular connectors can be inserted into any one of the receptacles.

7. The electrical connector assembly of claim 1, including a second polarizing groove in a second one of the side walls of the receptacle, and a polarizing rib on the modular connector remote from said latch projection for moving into the second polarizing groove.

8. The electrical connector assembly of claim 7 wherein said two polarizing grooves are in opposite side walls of the receptacle, and said polarizing rib and latch projection are on opposite sides of the modular-connector.

9. An electrical connector assembly, comprising:

a shroud having side walls forming a plurality of receptacles extending generally parallel to a mating axis, each receptacle including a polarizing groove in one of the side walls thereof extending from an insertion end of the shroud generally parallel to said mating axis, and a flexible latch arm integrally formed with the shroud in each of the polarizing grooves of each receptacle; and a modular connector insertable into each receptacle into said insertion end along the mating axis and including a transversely extending fixed latch flange adapted for moving into said polarizing groove of the respective receptacle and latchingly engaging the latch arm of the shroud in the respective polarizing groove, whereby the latch flange on each modular connector cooperates with the respective polarizing groove and latch arm on the shroud to perform the dual function of providing a polarizing means and a latch means for each modular connector in its respective receptacle.

10. The electrical connector assembly of claim 9 wherein each flexible latch arm is cantilevered in the direction of insertion of the respective modular connector into its receptacle of the shroud.

11. The electrical connector assembly of claim 9 wherein said receptacles are substantially identical, and said modular connectors have substantially identical outer configurations, whereby any one of the modular connectors can be inserted into any one of the receptacles.

12. The electrical connector assembly of claim 9, including a second polarizing groove in a second one of the side walls of each receptacle, and a polarizing rib on each modular connector remote from its latch flange for moving into the second polarizing groove.

13. The electrical connector assembly of claim 12 wherein said two polarizing grooves in each receptacle are in opposite side walls of the respective receptacle, and the polarizing rib and latch projection on each modular connector are on opposite sides of the connector.

14. An electrical connector assembly, comprising:

a shroud having side walls forming a receptacle defining a mating axis, a first polarizing groove in one of the side walls, a pair of second polarizing grooves in a side wall opposite the one side wall, all of the grooves extending generally parallel to said mating axis, and a latch in the first polarizing groove; and a modular connector insertable into said receptacle along said mating axis and including a latch projection on one side of the modular connector adapted for moving into said first polarizing groove and latchingly engaging the latch of the shroud in the first polarizing groove, and a pair of polarizing ribs on the modular connector remote from said latch projection and on a side of the connector opposite the latch projection, for moving into the second pair of polarizing grooves, whereby the latch projection on the modular connector cooperates with the first polarizing groove and the latch on the shroud to perform the dual function of providing a polarizing means and a latch means.

15. An electrical connector assembly, comprising:

a shroud having side walls forming a plurality of receptacles extending generally parallel to a mating axis, each receptacle including a first polarizing groove in one of the side walls, a pair of second polarizing grooves in a side wall opposite the one side wall, all of the grooves extending generally parallel to said mating axis, and a flexible latch arm in each of the first polarizing grooves of each receptacle; and a modular connector insertable into each receptacle along the mating axis and including a transversely extending latch flange on one side of the modular connector adapted for moving into said first polarizing groove of the respective receptacle and latchingly engaging the latch arm of the shroud in the respective first polarizing groove, and a pair of polarizing ribs on the modular connector remote from said latch flange and on a side of the connector opposite the latch flange, for moving into the pair of second polarizing grooves in the respective receptacle, whereby the latch flange on each modular connector cooperates with the respective first polarizing groove and latch arm on the shroud to perform the dual function of providing a polarizing means and a latch means for each modular connector in its respective receptacle.

* * * * *